United States Patent [19]

Lamberti

[11] Patent Number: 4,482,468

[45] Date of Patent: Nov. 13, 1984

[54] POWDERED NONIONIC-BASED DETERGENT COMPOSITIONS CONTAINING MAGNESIUM SULFATE

[75] Inventor: Vincent Lamberti, Upper Saddle River, N.J.

[73] Assignee: Lever Brothers Company, New York, N.Y.

[21] Appl. No.: 555,776

[22] Filed: Nov. 28, 1983

[51] Int. Cl.[3] ..... C11D 1/66; C11D 3/02

[52] U.S. Cl. ..... 252/133; 252/89.1; 252/174.21; 252/174.22; 252/174.23; 252/DIG. 1

[58] Field of Search ..... 252/DIG. 1, 174.21, 252/174.22, 133, 89.1, 174.23

[56] References Cited

U.S. PATENT DOCUMENTS

| | | | |
|---|---|---|---|
| 4,054,541 | 10/1977 | Mausner et al. | 252/89.1 X |
| 4,196,095 | 4/1980 | Cala et al. | 252/174.21 X |
| 4,260,651 | 4/1981 | Wixon | 252/174.21 X |
| 4,290,903 | 9/1981 | Macgilp et al. | 252/91 |
| 4,294,718 | 10/1981 | Kaeser | 252/135 |
| 4,328,114 | 5/1982 | Johnson et al. | 252/139 X |
| 4,417,994 | 11/1983 | Stoddart | 252/174.12 X |

*Primary Examiner*—John E. Kittle
*Assistant Examiner*—Mukund J. Shah
*Attorney, Agent, or Firm*—James J. Farrell

[57] ABSTRACT

The bleeding out during product storage of nonionic surfactants from powdered detergent compositions containing such surfactants is effectively arrested and retarded with the use of magnesium sulfate heptahydrate as a uniformly distributed and intimately mixed ingredient of such detergent compositions. Advantageously, the magnesium sulfate is mixed with the nonionic surfactant in anhydrous form and hydrated to its heptahydrate form thereafter. A mixture of magnesium sulfate heptahydrate together with polyvinyl alcohol when uniformly distributed within a detergent composition is also effective in arresting and retarding nonionic surfactant bleeding.

8 Claims, No Drawings

POWDERED NONIONIC-BASED DETERGENT COMPOSITIONS CONTAINING MAGNESIUM SULFATE

This invention relates to improved nonionic-based detergent formulations in powdered form. In particular, this invention relates to such nonionic-based detergent formulations in powdered form which further include magnesium sulfate heptahydrate as a stability promoting agent. Another aspect of this invention relates to a process for the making of said nonionic-based detergent formulations in powdered form. Still another aspect of this invention relates to an advantageous embodiment of said process.

By way of general background, it should be noted that in detergent compositions which employ nonionic surface active agents or detergents, there is a tendency of such detergent to "bleed out" from the detergent composition as a whole. Such bleeding is not necessarily dependent upon the nature of the container in which the detergent composition is placed. Thus, nonionic surface active agents are known to bleed out of detergent compositions and to adsorb themselves onto the glass walls of beakers in which they might have been placed. Naturally, in the consumer context, where such detergent compositions are ordinarily placed in cardboard boxes, such nonionic surfactant bleeding will be more severe as a result of the absorbent nature of such cardboard boxes. While such nonionic bleeding may be minimized by storing such detergent compositions in impervious receptacles such as plastic containers, the nonionic bleeding problem is not thereby totally eliminated. In the case of such impervious receptacles, the nonionic detergent active compound tends to bleed out of the powdered detergent composition in any event whereby it ends up being adsorbed upon the walls of such impervious receptacle.

The phenomenon of nonionic surfactant bleeding is undesirable for several reasons. Firstly, such bleeding leads to unsightly discoloration of the cardboard boxes in which a nonionic surfactant based powdered detergent composition is ordinarily placed for sale to the consuming public. As a result, not only is the aesthetic appeal and saleability of such a powdered detergent composition package reduced, but the performance of the detergent composition contained therein is itself adversely affected. Such adverse effects are twofold. Firstly, the loss of some of the surface active compound to the walls of the receptacle in question causes reduction of the cleaning strength of the detergent composition as a whole. Moreover, the powdered detergent composition in closest proximity to the absorbent walls of the container loses a greater proportion of its nonionic surfactant content, as opposed to those portions of such powdered detergent composition which are located at a greater distance from such walls. As a result, the powdered detergent composition contained in such a box becomes non-uniform with consequent unpredictability of its cleaning power and erosion of consumer confidence in the product in question.

Accordingly, a method of preventing nonionic surfactant bleeding in detergent compositions containing such nonionic surfactants would not only promote the storage life of such detergent compositions, but would also result in increased consumer appeal and acceptance of such detergent products. Moreover, by minimizing or eliminating the need to utilize plastic containers in favor of conventional cardboard type boxes or containers, further savings are effected in terms of packaging materials from which the consuming public can be expected to ultimately benefit. As already noted above, unless nonionic surfactant bleeding can be effectively arrested, even the more expensive plastic containers would not be entirely satisfactory.

It has now been surprisingly discovered that the undesirable phenomenon of nonionic surfactant bleeding from a powdered detergent composition can be minimized or eliminated by the intimate incorporation within such a detergent composition of magnesium sulfate heptahydrate.

It has now been surprisingly also found that the addition of magnesium sulfate in anhydrous form to the detergent composition or to a precursor of such detergent composition already containing the requisite amount of nonionic detergent active material followed by the addition of water of hydration as the last step in the mixing sequence produces superior results to the case where magnesium sulfate is added to the detergent composition as the heptahydrate.

According to the present invention, a particulate nonionic based non-phosphate detergent composition of improved storage stability wherein nonionic surfactant bleeding is minimized or eliminated further comprises magnesium sulfate heptahydrate in such an amount that the ratio of the total quantity by weight of the nonionic detergent active compound or compounds to that of the magnesium sulfate heptahydrate is in the range of about 10:2.3 to about 10:12 when the quantity of the magnesium sulfate heptahydrate is calculated on an anhydrous basis. Said ratio is preferably in the range of about 10:3.5 to about 10:4.7. In the most preferred aspect of the invention, said ratio is about 10:4.4.

In another aspect of the present invention, a particulate detergent composition of improved stability wherein the aforementioned ratio is 10:3.3 further comprises polyvinyl alcohol in such an amount that the ratio by weight of magnesium sulfate heptahydrate calculated on an anhydrous basis to polyvinyl alcohol is about 2.8:1.

In another aspect of the present invention, a method for making a nonionic based non-phosphate particulate detergent composition is provided which comprises the steps of (a) adding a nonionic detergent active compound or compounds to a pulverized particulate mixture comprising finely divided magnesium sulfate heptahydrate to form a detergent mixture; (b) optionally adding further particulate matter comprising further detergent materials to the detergent mixture to form an ultimate mixture; and (c) blending the ultimate mixture thoroughly.

A preferred embodiment of the method of the present invention involves the use of anhydrous magnesium sulfate which comprises the steps of (a) adding a nonionic detergent active compound or compounds to a pulverized particulate mixture comprising finely divided anhydrous magnesium sulfate to form a detergent mixture; (b) adding water to the detergent mixture in an amount sufficient to at least convert the anhydrous magnesium sulfate to magnesium sulfate heptahydrate to form a hydrated detergent mixture; (c) optionally adding further particulate matter comprising further detergent materials to the hydrated detergent mixture to form an ultimate mixture; and (d) blending the ultimate mixture thoroughly.

The following illustrative but non-limiting Examples will aid in a fuller understanding of the present invention.

EXAMPLE I

Table 1 noted below lists the ingredients of detergent composition A containing magnesium sulfate heptahydrate and detergent composition B not containing magnesium sulfate heptahydrate which were initially compared against each other with respect to the rate of nonionic surfactant bleeding. Both compositions contained an identical percentage w/w of the same nonionic surfactant.

TABLE 1

| Ingredients | Percentages w/w Detergent Composition A | Detergent Composition B |
|---|---|---|
| $Na_2SO_4$ | 23.32 | 39.8 |
| $Na_2CO_3$ | 33.25 | 33.25 |
| $MgSO_4.7H_2O$ | 20.48 | — |
| Neodol 45-13 (nonionic surfactant) | 8.55 | 8.55 |
| Britesil H-24 (80% solid, 20% water) | 12.50 | 12.50 |
| Diatomaceous earth | 1.90 | 1.90 |
| Water (added) | 0.00 | 4.00 |

NOTES:
Neodol 45-13 is a trademark of Shell Chemical Company for a $C_{14}$–$C_{15}$ linear primary alcohol ethoxylated with 13 moles of ethylene oxide.
Britesil H-24 is a trademark of Philadelphia Quartz Company for a hydrous sodium polysilicate with a 2.4 wt. ratio of ($SiO_2/Na_2O$).

The respective compositions were mixed using a domestic use blender, i.e., a Kitchen Aid brand cake mixer and a "V" blender (Patterson-Kelley Company, Division of Daylor-Wharton Company, Harsco Corp.) in the manner further described below.

In detergent composition A, the sodium sulfate, sodium carbonate and magnesium sulfate heptahydrate were mixed together and comminuted in the Kitchen Aid blender. Thereafter, the nonionic surfactant was added to the comminuted particulate matter to form a detergent mixture. The detergent mixture was then transferred to the "V" blender where diatomaceous earth and Britesil H-24 were subsequently added, followed by approximately 15 minutes of mixing.

Detergent composition B was prepared by charging the Kitchen Aid blender with sodium sulfate and sodium carbonate, comminuting the charge followed by the addition of water (4% w/w) finally followed by the nonionic surfactant with continued blending. The resulting detergent mixture was thereafter transferred to the "V" blender where diatomaceous earth and Britesil H-24 were subsequently added, followed by approximately 15 minutes of further mixing.

The nonionic surfactant bleeding rate of the resulting compositions was determined with the aid of a Modified Ong Test. The Ong Test is described in U.S. Pat. No. 4,328,114.

In the modified form of said test as employed herein, 9 pre-weighed blotters consisting of ashless No. 42 filter paper were used per experimental test.

All filter paper blotters were cut to fit snugly around the inner circumference of a 150×75 mm. evaporating dish. Three pre-cut blotters were initially placed upon the bottom of the evaporating dish, followed by an approximately 133 grams layer of the detergent powder. A further layer of three blotters was placed upon such detergent powder layer followed by another detergent powder layer of approximately 133 grams. The foregoing procedure was repeated a third time whereby three distinct layers of detergent powder in cylindrical form each separated from the layer immediately above it by a layer of three blotters was obtained, wherein the bottom layer was not in direct contact with the bottom of the evaporating dish but through an intervening layer of three blotters. The upper surface of the uppermost detergent powder layer was not covered by any blotters.

The entire assembly was sealed with Parafilm brand (American Can Company) wrap and subjected to the test temperature of 95° F. The aforementioned temperature, being somewhat higher than the ambient temperature prevailing under normal storage conditions was intended to speed up the usual rate of nonionic surfactant bleeding.

In each case, the amount of nonionic bleeding was calculated from the total increase in weight of all 9 blotters at the expiration of each test time period.

Table 2 noted below shows that detergent composition A containing magnesium sulfate heptahydrate exhibited a significantly lower rate of nonionic surfactant bleeding compared to detergent composition B which did not contain magnesium sulfate heptahydrate.

TABLE 2

Modified Ong Test Results - 6 Weeks at 95° F.

| | Nonionic Bleeding Rate: gms of nonionic transferred to the 9 blotters | % of nonionic bleeding* |
|---|---|---|
| Detergent Composition A | 2.25 | 6.58 |
| Detergent Composition B | 4.59 | 13.42 |

*The percentages shown are based upon the maximum available amount of nonionic surfactant present in three layers of about 133 grams each of detergent compositions each comprising 8.55% w/w of the nonionic surfactant. 8.55% w/w of the total approximate quantity of 400 grams of the respective detergent compositions translates to a theoretical maximum amount of 34.2 grams of nonionic surfactant which was available for transfer to the respective blotters.

The foregoing experimental data show that more than twice as much nonionic surfactant was lost as a result of bleeding from detergent composition B as compared to detergent composition A comprising the magnesium sulfate heptahydrate of the present invention.

EXAMPLE II

Following the general procedures noted for detergent composition A and detergent composition B, the further detergent compositions noted in Table 3 below were prepared. However, in the case of detergent composition C, the 4% w/w water required to hydrate the anhydrous magnesium sulfate was added to the batch in the Kitchen Aid mixer after the nonionic surfactant had been added thereto, and prior to the transfer of the pulverized detergent mixture to the "V" blender.

TABLE 3

| Ingredients | Percentages w/w Detergent Composition C | Detergent Composition D | Detergent Composition E | Detergent Composition F |
|---|---|---|---|---|
| $Na_2SO_4$ | 36.00 | 36.00 | 39.8 | See note |

TABLE 3-continued

| Ingredients | Percentages w/w Detergent Composition C | Detergent Composition D | Detergent Composition E | Detergent Composition F |
|---|---|---|---|---|
| | | | | below |
| $Na_2CO_3$ | 33.25 | 33.25 | 33.25 | |
| $MgSO_4$ (anhydrous) | 3.80 | — | — | |
| $MgSO_4.7H_2O$ | — | 7.80 | — | |
| Neodol 45-13 | 8.55 | 8.55 | 8.55 | |
| Britesil H-24 | 12.50 | 12.50 | 12.50 | |
| Diatomaceous earth | 1.9 | 1.9 | 1.90 | |
| Water (added) | 4.0[a] | 0.0 | 4.00 | |

[a]This amount is sufficient to convert 3.80% $MgSO_4$ (anhydrous) to 7.80% $MgSO_4.7H_2O$

NOTE:

This composition was identical with Detergent Composition E, except that it was aged at room temperature (before testing for nonionic bleeding) in a glass vessel for six (6) weeks.

The four compositions noted above were subjected to the Modified Ong Test in accordance with the procedure described above. The results obtained are summarized in Table 4 below.

TABLE 4

Modified Ong Test Results (6 Weeks at 95° F.)

| Composition | gms of nonionic transferred to the 9 blotters | % of nonionic bleeding |
|---|---|---|
| Composition C ($MgSO_4$ added in anhydrous form) | 1.5 | 4.39 |
| Composition D ($MgSO_4$ added in the form of the heptahydrate) | 2.3 | 6.73 |
| Composition E (Fresh) | 6.3 | 18.42 |
| Composition F (Aged) | 4.3 | 12.57 |

The foregoing results demonstrate that a 7.80% w/w quantity of magnesium sulfate heptahydrate was sufficient to inhibit nonionic bleeding from the detergent powder composition tested. In fact, in the case of compositions C and D, the amount of nonionic bleeding which was measured was substantially equivalent (and even superior in the case of composition C) to the results obtained with composition A which contained 20.48% magnesium sulfate heptahydrate.

It is also evident that composition C which contained magnesium sulfate heptahydrate formed in situ showed a significant retardation in nonionic bleeding compared to Composition D which employed magnesium sulfate heptahydrate initially.

Aged control composition F registered less nonionic surfactant bleeding than was the case with its freshly prepared counterpart control composition E. This difference in behavior can be explained by taking into account the loss of nonionic surfactant to the walls of the container of the aged product before it was removed therefrom for the Modified Ong Test evaluation.

EXAMPLE III

The tests noted herein demonstrate the rates at which a nonionic surfactant bleeds out of a typical detergent composition. Accordingly, detergent composition G and detergent composition H were freshly prepared for further testing. Detergent composition G was an identical remake of detergent composition A, and detergent composition H was an identical remake of detergent composition B. The respective batches of detergent composition G and detergent composition H were each subdivided into five samples of 400 grams each, and each sample subjected to the Modified Ong Test for the respective test periods (at 95° F.) noted in Table 5 below.

TABLE 5

Modified Ong Test Results (Rate of Nonionic Bleeding)

| Test period | gms of nonionic per 400 gm of product (initially containing 8.55% w/w of nonionic surfactant) transferred to the 9 blotters: 10 days | 11 days | 22 days | 28 days | 42 days |
|---|---|---|---|---|---|
| Detergent Composition G (containing $MgSO_4.7H_2O$) | 2.0 | 2.0 | 2.3 | 2.4 | 2.5 |
| Detergent Composition H | 3.5 | 3.5 | 3.9 | 3.9 | 4.1 |

The data shown in Table 5 above demonstrate that most of the nonionic surfactant bleeding loss occurred during the first two to three weeks after the detergent composition was made. Once again, it will be seen that not only was the overall nonionic surfactant bleeding greater in the case of detergent composition H (which did not contain magnesium sulfate heptahydrate) but that the amount of such bleeding was greatest during the first two to three weeks following the making of such composition, and additional bleeding after this time was minimal or practically non-existent.

It is evident that magnesium sulfate heptahydrate not only retards the enhanced rate of bleeding normally encountered in the first two to three weeks following the preparation of a nonionic surfactant based composition, but it continues to retard such bleeding over the entire test period.

EXAMPLE IV

Further tests were conducted to investigate the utility of $Na_2CO_3.H_2O$, polyvinyl alcohol (PVA) as well as workable and optimal lower use levels of magnesium sulfate. To that end, detergent compositions I, J, K, L, M and N as shown in Table 6 below were prepared following the general procedure used with compositions A and B. In compositions I and J, which contained magnesium sulfate heptahydrate, the magnesium sulfate as it was initially employed was in anhydrous form, and it was hydrated after the addition thereto of the nonionic surfactant.

TABLE 6

| Ingredients | Percentages w/w I | J | K | L | M | N |
|---|---|---|---|---|---|---|
| $Na_2SO_4$ | 37.80 | 36.00 | 38.80 | 36.80 | 39.80 | 39.8 |
| $Na_2CO_3$ (anhydrous) | 33.25 | 33.25 | 33.25 | 33.25 | 23.25 | 33.25 |
| $Na_2CO_3.H_2O$ | — | — | — | — | 11.70 | — |

TABLE 6-continued

| Ingredients | Percentages w/w | | | | | |
|---|---|---|---|---|---|---|
| | I | J | K | L | M | N |
| $MgSO_4$ (anhydrous) | 2.00 | 2.80 | — | — | — | — |
| Polyvinyl alcohol (PVA)* | — | 1.00 | 1.00 | 3.00 | — | — |
| Neodol 45-13 | 8.55 | 8.55 | 8.55 | 8.55 | 8.55 | 8.55 |
| Britesil H-24 | 12.50 | 12.50 | 12.50 | 12.50 | 12.50 | 12.50 |
| Diatomaceous earth | 1.90 | 1.90 | 1.90 | 1.90 | 1.90 | 1.90 |
| Water (added) | 4.00 | 4.00 | 4.00 | 4.00 | 2.30 | 4.00 |

*high molecular weight, 99-100% hydrolyzed - Aldrich Chemical Company, Inc.

All of the above noted six compositions were subjected to the Modified Ong Test described previously at two different time intervals, and the results obtained are noted in Table 7 below.

TABLE 7

Modified Ong Test Results at 95° F.

| | gms of non-ionic bleeding into 9 blotters | | % of non-ionic bleeding | |
|---|---|---|---|---|
| | 2 weeks | 6 weeks | 2 weeks | 6 weeks |
| Detergent Composition I (2% w/w $MgSO_4$, anhydrous) | 1.7 | 2.8 | 4.97 | 8.19 |
| Detergent Composition J (2.8% w/w $MgSO_4$, anhydrous + 1% w/w PVA) | 1.8 | 2.3 | 5.26 | 6.73 |
| Detergent Composition K (1% w/w PVA) | 3.8 | 4.3 | 11.11 | 12.57 |
| Detergent Composition L (3% w/w PVA) | 3.3 | 3.8 | 9.65 | 11.11 |
| Detergent Composition M (11.7% w/w $Na_2CO_3.H_2O$) | 4.5 | 5.0 | 13.16 | 14.62 |
| Detergent Composition N | 4.5 | 4.9 | 13.16 | 14.33 |

The data reflected in Table 7 clearly demonstrate that the least nonionic surfactant bleeding was encountered in compositions comprising magnesium sulfate heptahydrate. Although the incorporation of polyvinyl alcohol showed some benefit especially at the higher use level of 3% w/w as compared to detergent composition N, it was nonetheless not as effective as magnesium sulfate heptahydrate on a comparable weight basis nor was its use as economical as the use of magnesium sulfate heptahydrate. However, detergent composition J containing 2.8% w/w magnesium sulfate (anhydrous) together with 1% w/w PVA was found to be as stable as detergent composition D containing 7.80% w/w magnesium sulfate heptahydrate.

It is also evident that sodium carbonate monohydrate was inefficient in suppressing nonionic surfactant bleeding.

As little as 2% w/w magnesium sulfate (anhydrous) was found to be effective. On the other hand, as much as 20.48% w/w magnesium sulfate heptahydrate was found to be effective although not markedly superior in the results obtained. The upper effective limit is therefore determined both by the principle of diminishing returns (and the attendant economic considerations) as well as the fact that the magnesium ion associated with magnesium sulfate heptahydrate imparts additional hardness to the water with which such detergent compositions are to be used.

The optimum use level for magnesium sulfate (anhydrous) as determined herein appears to be between 3 and 4% w/w. A detergent composition containing 2.8% w/w magnesium sulfate (anhydrous) further containing 1% w/w PVA was also found to be of acceptable stability.

Since in all the detergent compositions tested herein, the nonionic detergent quantity was 8.55% w/w, a range of 2 to 10% w/w magnesium sulfate (anhydrous) as tested herein translates to a nonionic detergent to magnesium sulfate (anhydrous) ratio of about 10:2.3 to about 10:12. The comparable ratio for the preferred magnesium sulfate (anhydrous) range of 3 to 4% w/w lies in the range of about 10:3.5 to about 10:4.7. The preferred amount of magnesium sulfate (anhydrous) of 3.8% w/w translates to the corresponding ratio of about 10:4.4. Detergent composition J (2.8% w/w $MgSO_4$ (anhydrous) + 1% w/w PVA) reflects the ratio of the nonionic detergent to anhydrous magnesium sulfate of about 10:3.3. Moreover, the ratio of magnesium sulfate (anhydrous) to polyvinyl alcohol therein is about 2.8:1.

Additionally, as the differences between the nonionic surfactant bleeding rates noted between detergent compositions C and D indicate, it is preferable to add magnesium sulfate to the respective detergent compositions or their precursors in anhydrous form and to hydrate said magnesium sulfate only after it or a precursor mixture containing it has been mixed with the nonionic detergent compound or compounds which are incorporated in the resulting detergent compositions. Thereby, the intimacy of admixture of the magnesium sulfate heptahydrate with the nonionic detergent is enhanced with attendant superiority of results in the arrest and/or inhibition of nonionic bleeding.

While in all the compositions tested herein, the level of nonionic surfactant employed was 8.55% w/w, the amount which is used in practice may range from about 5% w/w to about 25% w/w. Moreover, a detergent composition may, in addition to nonionic surfactants contain other surfactants, e.g., those which are anionic (including soaps), cationic, zwitterionic and ampholytic. In such a mixed detergent composition, the actual amount of nonionic surfactant present may even be less than 5% w/w if the balance is made up by the other surfactants. But, in any event, the actual amount of nonionic surfactant employed will be determinative of the corresponding amount of magnesium sulfate heptahydrate gainfully employed consistent with the ratios contemplated by the invention.

The scope of the present invention is further defined by and should be read in conjunction with the appended claims.

What is claimed is:

1. A particulate non-phosphate detergent composition comprising a nonionic detergent active compound or compounds which further comprises in intimate admixture therewith an effective amount of magnesium sulfate heptahydrate to substantially arrest and/or inhibit nonionic bleeding from said detergent composition.

2. The particulate detergent composition of claim 1 wherein the ratio w/w of the total quantity of the nonionic detergent active compound or compounds to that of the magnesium sulfate heptahydrate calculated on an anhydrous basis is in the range of about 10:2.3 to about 10:12.

3. The particulate detergent composition of claim 2 wherein the ratio is in the range of about 10:3.5 to about 10:4.7.

4. The particulate detergent composition of claim 3 wherein the ratio is about 10:4.4.

5. The particulate detergent composition of claim 2 wherein the ratio is about 10:3.3.

6. The particulate detergent composition of claim 5 which further comprises polyvinyl alcohol wherein the ratio w/w of magnesium sulfate heptahydrate calculated on an anhydrous basis to polyvinyl alcohol is about 2.8:1.

7. A method for making the particulate detergent composition of claim 1 which comprises the steps of (a) adding a nonionic detergent active compound or compounds to a pulverized particulate mixture comprising finely divided magnesium sulfate heptahydrate to form a detergent mixture; (b) optionally adding further particulate matter to the detergent mixture to form an ultimate mixture; and (c) blending the ultimate mixture thoroughly.

8. A method for making the particulate detergent composition of claim 1 which comprises the steps of (a) adding a nonionic detergent active compound or compounds to a pulverized particulate mixture comprising finely divided anhydrous magnesium sulfate to form a detergent mixture; (b) adding water to the detergent mixture in an amount sufficient to at least convert the anhydrous magnesium sulfate to magnesium sulfate heptahydrate to form a hydrated detergent mixture; (c) optionally adding further particulate matter to the hydrated detergent mixture to form an ultimate mixture; and (d) blending the ultimate mixture thoroughly.

* * * * *